US006350044B1

(12) United States Patent
Lea

(10) Patent No.: US 6,350,044 B1
(45) Date of Patent: Feb. 26, 2002

(54) LUMINAIRE WITH CENTRAL REFLECTOR SURROUNDED BY LIGHT TRANSMITTING AND SPREADING OPTICAL SHEET HAVING STRUCTURED SURFACE

(75) Inventor: Michael C. Lea, Bracknell (GB)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/646,362

(22) PCT Filed: Jan. 13, 2000

(86) PCT No.: PCT/US00/00811

§ 371 Date: Sep. 14, 2000

§ 102(e) Date: Sep. 14, 2000

(87) PCT Pub. No.: WO00/42351

PCT Pub. Date: Jul. 20, 2000

(30) Foreign Application Priority Data

Jan. 14, 1999 (GB) ..... 9900818

(51) Int. Cl.[7] ..... F21V 7/00

(52) U.S. Cl. ..... 362/298; 362/309; 362/351; 362/355; 362/308

(58) Field of Search ..... 362/307, 308, 362/309, 311, 351, 355, 298

(56) References Cited

U.S. PATENT DOCUMENTS

| | | | | |
|---|---|---|---|---|
| 4,241,388 A | * | 12/1980 | Green | 362/516 |
| 4,536,828 A | | 8/1985 | Mori | |
| 4,657,355 A | | 4/1987 | Negishi | |
| 4,987,524 A | * | 1/1991 | Miller | 362/355 |
| 5,105,347 A | | 4/1992 | Ruud et al. | |
| 5,184,550 A | | 2/1993 | Beck et al. | |
| 5,551,042 A | | 8/1996 | Lea et al. | |
| 5,711,592 A | * | 1/1998 | Hotta | 362/496 |
| 5,882,774 A | | 3/1999 | Jonza et al. | |

FOREIGN PATENT DOCUMENTS

| | | | |
|---|---|---|---|
| WO | WO 91/18304 | 11/1991 | G02B/3/00 |
| WO | WO 97/01774 | 1/1997 | G02B/1/10 |
| WO | WO 00/42451 | 7/2000 | G02B/5/14 |

* cited by examiner

*Primary Examiner*—Sandra O'Shea
*Assistant Examiner*—Ronald E. DelGizzi

(57) ABSTRACT

A luminaire for distributing light from a light source (7). The luminaire includes one or more reflectors (2, 3), placed symmetrically about the lamp (7) to reflect the light output from the lamp (7). One or more light spreading devices (4, 5) are provided around the reflectors (2, 3) to receive the light reflected by the reflectors (2, 3). Such a luminaire provides for uniform distribution of light while minimizing glare from the light fitting.

1 Claim, 1 Drawing Sheet

LUMINAIRE WITH CENTRAL REFLECTOR SURROUNDED BY LIGHT TRANSMITTING AND SPREADING OPTICAL SHEET HAVING STRUCTURED SURFACE

The invention relates to a luminaire and in particular, a luminaire for distributing light from a light source, such as a high powered lamp.

One of the problems with interior lighting of large buildings such as warehouses, factories or exhibition halls, is ensuring that light from the light source is distributed sufficiently evenly over the floor area. In addition, it is important to ensure that the glare from the light fitting is minimised. A typical figure for glare from a fitting is that the glare should be below 10,000 cd/m$^2$ for viewing angles below 50° elevation.

In accordance with the invention there is provided a luminaire for distributing the output of a light source, the luminaire comprising:

(a) a mount for said light source, (b) a central reflector positioned so as to reflect the output of the light source, the reflector being convex towards the light source, and (c) a light transmitting and spreading device surrounding the central reflector and positioned so as to receive the light reflected by the central reflector, wherein the light transmitting and spreading device comprises an optical sheet material having a structured surface for deviating and spreading the light transmitted by the sheet.

The term "light", as used herein, refers to electromagnetic radiation in the ultra violet, visible or infra-red regions of the electromagnetic spectrum.

In one embodiment of the invention the central reflector is surrounded by one or more additional reflectors, the outermost of which is concave towards the light source. An advantage of such an arrangement is that by providing two or more reflectors angled relative to each other it is possible to provide a luminaire which spreads light to below the luminaire and also to the sides of the luminaire. Preferably, the central reflector has a central axis which is coincident with the central axis of the additional reflector(s). In one arrangement, the central reflector comprises a conical shape tapering towards the light source, and a second reflector surrounding the central reflector comprises a hollow frusto-conical shape tapering away from the light source.

In an alternative example of the invention, the central reflector comprises a number of triangular planar reflecting surfaces which define a pyramidal shape pointing towards the light source. Typically the pyramid defined by the surfaces of the central reflector may be eight-sided. A second reflector, surrounding the central reflector, may take the form of a hollow truncated pyramid with the same number of sides as the central reflector, but tapering away from the light source. Such a reflector comprises surfaces in the shape of quadrilaterals, each having one pair of opposite sides parallel and one pair of opposite sides convergent, the quadrilaterals being mutually linked by their convergent sides. Preferably, the second reflector is mounted adjacent to the peripheral edge of the central reflector which is remote from the light source.

The reflector(s) may be formed from any suitable reflective material, preferably a specularly reflective material, such as metal, metallised glass or metallised plastic film, or mirror film as described in U.S. Pat. No. 5,882,774 and WO 97/01774.

A spreading device is positioned so as to collect and spread the light reflected by the reflector(s). Preferably, the spreading device comprises at least a first spreader formed from the optical sheet material in the shape of a hollow truncated cone or pyramid whose central axis coincides with the central axis of the central reflector, and which is concave towards the reflector(s). When there are two reflectors, the spreading device preferably additionally comprises a second spreader, which is also formed from an optical sheet material, the first and second spreaders being positioned so that the first spreader collects and spreads light reflected by the central reflector, and the second spreader collects and spreads light reflected by the second reflector.

The second spreader is preferably mounted adjacent to the peripheral edge of the first spreader which is remote from the reflectors.

The second spreader typically (but not necessarily) is in the shape of an annulus or annular polygon.

Typically, the second spreader comprises a number of quadrilateral spreader surfaces having one pair of opposite sides parallel, the quadrilaterals being coupled to each other at the non-parallel sides to form an annular polygon. Typically, the first spreader also comprises a number of corresponding quadrilateral sections which are coupled to each other at the non-parallel sides and form an annular polygon around the external periphery of the second spreader.

The luminaire also includes a lamp mounting mechanism to permit a light source to be mounted in the luminaire. Preferably, the light source may be mounted in the luminaire via a central aperture in the spreading device. Typically, the central axis of the aperture is substantially coincident with the central axis of the central reflector. In the case in which the light source emits light in a cone and the mount is arranged such that the axis of the cone is coaxial with the centre of the central reflector.

In normal circumstances, the axis of the emission cone is vertical, with the light being emitted upwards towards the central reflector, which diverts it sideways and downwards through the spreading device to illuminate a large floor area. While acceptable results can be obtained using a single reflector and a single spreader, this arrangement may leave a small area immediately below the light source under-illuminated. Use of a second reflector, angled relative to the central reflector as described above, ensures that a proportion of the light is reflected substantially vertically downwards, so that it may be collected by a second spreader and distributed over the area immediately below the lamp.

The spreading device may be a transmission device which spreads the incident light. Translucent glass or plastic diffusers may be employed but preferably the spreaders comprise an optical sheet (e.g. a film) having a structured surface to deviate the light. Such optical sheets are known and disclosed, for example, in U.S. Pat. Nos. 4,657,355, 5,551,042 and WO91/18304. Suitable optical sheets may have a structured surface comprising an array of Fresnel lenses, particularly an array of negative Fresnel lenses, or two crossed cylindrical Freenel is lenses. Other suitable optical sheets are described in our co-pending PCT Patent application Ser. No. 09/646,362 filed on the same day as the present application.

As a further alternative, two transparent sheets having a linear structured surface may be used, the sheets overlapping each other with the directions of the linear structures at substantially right angles to each other.

In one example of the invention, the luminaire may comprise a third reflector which may reflect optical radiation from the central reflector to the spreading device.

The use of generally conical reflectors in luminaires in which light is emitted vertically by the light source is known, as may be seen from U.S. Pat. Nos. 5,184,550, 5,105,347 and 4,536,828.

An example of a luminaire in accordance with the invention will now be describe with reference to the accompanying drawings, in which.

Figure 1:
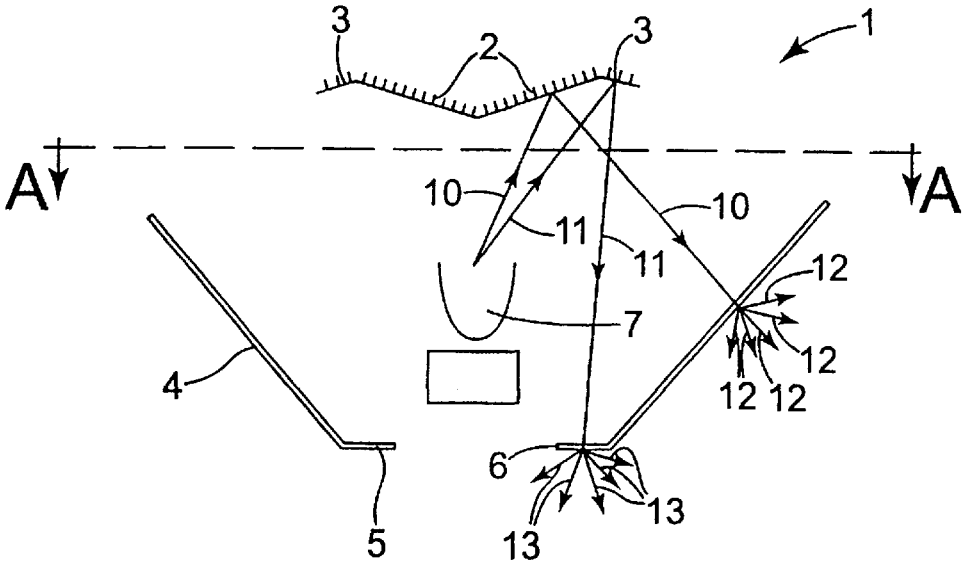
FIG. 1 is a schematic cross-sectional view of a luminaire.

FIG. 1 is a schematic cross-sectional view of a luminaire (1) which includes a central reflector (2) which is encircled by a second (outer) reflector (3). A first spreader (4) (hereinafter referred to as the side spreader) and a second spreader (5) (hereinafter referred to as the bottom spreader) are located generally opposite the central and outer reflectors (2, 3) respectively. The bottom spreader (5) is annular, and a central aperture (6) permits a lamp (7) to be inserted and mounted in the luminaire (1) through the aperture (6).

Figure 2:
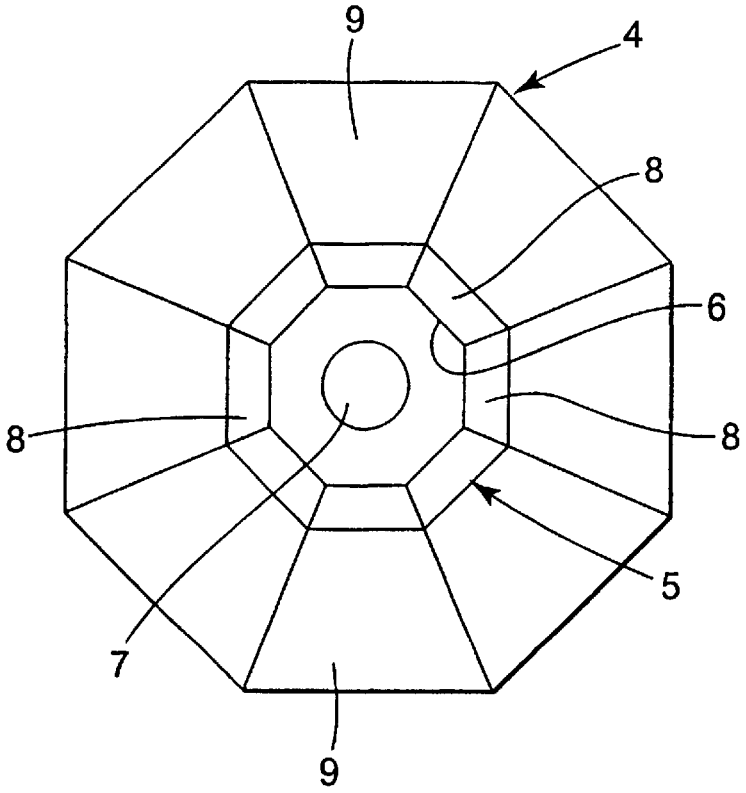
FIG. 2 is a view along the line A—A in FIG. 1.

The central reflector (2) comprises eight identical planar triangular shaped mirrors forming an eight-sided pyramid pointing towards the lamp (7), and therefore is convex towards the lamp, with the bases of the triangles forming a peripheral edge remote from the lamp. The outer reflector (3) comprises eight identical planar quadrilateral shaped mirrors mounted around the peripheral edge of the central reflector. Each quadrilateral has one pair of opposite sides parallel and one pair of opposite sides convergent. The shorter sides in the pairs of parallel sides are equal in length to the bases of the triangles forming the central reflector, and are positioned in contact with same, the quadrilaterals being mutually linked via the convergent sides. The outer reflector thus takes the form of a hollow truncated pyramid tapering away from the lamp. The arrangement of the bottom spreader (5) and side spreader (4) is shown in more detail in FIG. 2 where it can be seen that the bottom spreader (5) comprises eight identical planar quadrilateral spreader panels (8). Each quadrilateral has one pair of opposite sides parallel and one pair of opposite sides convergent, and the quadrilaterals are mutually linked via the convergent sides to form a planar annular octagon. Similarly, the side spreader (4) comprises eight quadrilateral-shaped side spreader panels (9) having pairs of parallel and convergent sides, but in this case the quadrilaterals are linked via their convergent sides so as to form a section of an eight sided pyramid, which tapers in the same direction as the central reflector (2).

It will be appreciated that the reflectors and spreaders may have a variety of different constructions to achieve the desired optical effect. For example, different shaped planar segments may be employed or continuously curved reflectors and/or spreaders may be used. The central reflector (2) may be conical, the outer reflector (3) and the side spreader (4) may be frusto-conical and the bottom spreader (5) may be in the form of an annular disc. Combinations of segmented and continuous spreaders and/or reflectors may be employed.

The lamp (7) may be any suitable light source, from which it is desired to distribute the light. However, the luminaire (1) is particularly useful where the lamp (7) is a high power lamp such as a HID lamp, or preferably a sulphur plasma lamp e.g. as commercially available from Fusion Lighting Inc., Maryland, United States of America, under the trade name Solar 1000.

Light is emitted from the lamp in a narrow cone and is shown schematically in FIG. 1 by rays (10, 11). The ray of light (10) emitted from the lamp (7) is incident on the central reflector (2) and is thereby reflected to be incident on the side spreader (4). The side spreader (4) spreads the light ray (10) into a variety of directions indicated by the arrows (12). Hence, light (10) emitted from the lamp (7), and reflected from central reflector (2), is spread by the side spreader (4) sideways from the luminaire (1).

Similarly, light (11) from the lamp (7) which is incident on the outer reflector (3) is thereby reflected to the bottom spreader (5). The light (11) incident on the bottom spreader (5) is spread in a number of different directions, as indicated by the arrows (13), and illuminates the area directly below the lamp (7).

In another alternative of the design of the luminaire (1), it is possible that the bottom spreader (5) and associated outer reflector (3) may be dispensed with, provided that the side spreader (4) has enough angular spread to spread the light (12) into the area of the floor directly below the lamp (7).

In a further example of the invention, especially if illumination is only required below the luminaire (1), a further mirror may be present to reflect light from the central reflector to the bottom spreader (5) and thereby eliminate the side spreaders (4).

With the luminaire (1) described above, the fraction of the intensity of the lamp (7) diverted to the bottom spreader (5) is controlled by the diameter of the central reflector (2) and by the distance of the lamp (7) from the central reflector (2). It is possible that the mounting in the luminaire for the lamp (7) may be vertically adjustable to permit a user or installer of the luminaire (1) to adjust the illumination levels below the luminaire (1) after the luminaire (1) has been installed.

The bottom spreader (5) and side spreader (4) may be any transmission device which spreads light incident on the device. For example, the spreaders (4, 5) may be translucent plastic diffusers. However, preferably, the spreaders comprise an optical sheet having a structured surface.

In one example of the invention, the sheet having a structured surface could be in accordance with the structured form described in U.S. Pat. No. 5,551,042, that is structured surface may form a plurality of negative Fresnel lenses, which may be either radial or linear. Alternatively, an optical sheet having a structured surface formed from a plurality of positive Fresnel lenses could also be used, or an optical sheet as described in our co-pending PCT Patent application Ser. No. WO 00/42451 filed on the same day as the present application.

Preferably, the side spreaders spread light into a solid angle with a half-angle spread of 20° to 60°. Typically, the bottom spreader (5) may spread light into a solid angle with a half-angle spread of up to 90°.

In addition, one or both of the spreaders (4, 5) may spread light asymmetrically.

As a further modification, natural light can be introduced into the luminaire from above, through the gap between the outer edge of the outer reflector (3) and the upper edge of the side spreader (4).

What is claimed is:

1. A luminaire for distributing the output of a light source, the luminaire comprising:

(a) a mounting mechanism for said light source, (b) a central reflector positioned so as to reflect the output of the light source, the reflector being convex towards the light source, and (c) a light transmitting and spreading device surrounding the central reflector and positioned so as to receive the light reflected by the central reflector, wherein the light transmitting and spreading device comprises an optical sheet material having a structured surface for deviating and spreading the light transmitted by the sheet.

* * * * *